US008794731B2

(12) United States Patent
Watanabe et al.

(10) Patent No.: US 8,794,731 B2
(45) Date of Patent: Aug. 5, 2014

(54) IMAGE FORMING SYSTEM AND INSERTION METHOD

(75) Inventors: Takahiro Watanabe, Kanagawa (JP); Shingo Matsushita, Tokyo (JP); Takeshi Sasaki, Kanagawa (JP); Satoshi Saito, Kanagawa (JP); Ikuhisa Okamoto, Kanagawa (JP); Akira Kunieda, Tokyo (JP); Jun Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 254 days.

(21) Appl. No.: 13/404,112

(22) Filed: Feb. 24, 2012

(65) Prior Publication Data

US 2012/0229551 A1 Sep. 13, 2012

(30) Foreign Application Priority Data

Mar. 7, 2011 (JP) ..... 2011-049098

(51) Int. Cl.
*B41J 29/38* (2006.01)

(52) U.S. Cl.
USPC ..... 347/16; 700/220; 700/223

(58) Field of Classification Search
USPC ..... 270/58.06; 700/220; 347/5, 9, 16
IPC ..... B41J 13/12
See application file for complete search history.

(56) References Cited

U.S. PATENT DOCUMENTS

| | | | | |
|---|---|---|---|---|
| 5,818,724 | A * | 10/1998 | Brewster et al. | 700/220 |
| 2001/0032033 | A1* | 10/2001 | Krasuski et al. | 700/220 |
| 2009/0232622 | A1 | 9/2009 | Okada et al. | |
| 2009/0252545 | A1 | 10/2009 | Sasaki | |
| 2009/0257846 | A1 | 10/2009 | Matsushita et al. | |
| 2009/0263212 | A1 | 10/2009 | Sasaki et al. | |
| 2009/0269167 | A1 | 10/2009 | Iida et al. | |
| 2010/0226733 | A1 | 9/2010 | Ilda et al. | |
| 2010/0239391 | A1 | 9/2010 | Sasaki et al. | |
| 2010/0329821 | A1 | 12/2010 | Sasaki et al. | |
| 2011/0184889 | A1 | 7/2011 | Tokita et al. | |
| 2011/0220557 | A1 | 9/2011 | Sasaki et al. | |
| 2011/0277418 | A1 | 11/2011 | Kunieda et al. | |
| 2012/0131885 | A1 | 5/2012 | Matsushita et al. | |

FOREIGN PATENT DOCUMENTS

| | | |
|---|---|---|
| JP | 2004-045650 A | 2/2004 |
| JP | 2005-015227 A | 1/2005 |

* cited by examiner

*Primary Examiner* — Lam S Nguyen
(74) *Attorney, Agent, or Firm* — Harness, Dickey & Pierce, P.L.C.

(57) ABSTRACT

An image forming system includes an enclosure supply device including an enclosure container, a first image forming unit to form an image on the sheet, an envelope supply device including an envelope container, an input device to input an insertion job, an insertion device to insert into the envelope at least one sheet on which the first image forming unit has formed the image and including a temporary storage tray to temporarily store the sheets inserted into the envelope as well as an envelope retainer to hold the envelope at an insertion position where the sheets are inserted into the envelope, and a controller to cause the second image forming unit to complete image formation on the envelope and conveyance of the envelope to the insertion position before a last sheet of the multiple sheets inserted into the single envelope reaches the temporary storage tray.

6 Claims, 17 Drawing Sheets

IMAGE FORMING SYSTEM AND INSERTION METHOD

CROSS-REFERENCE TO RELATED APPLICATION

This patent application is based on and claims priority pursuant to 35 U.S.C. §119 to Japanese Patent Application No. 2011-049098, filed on Mar. 7, 2011, in the Japan Patent Office, the entire disclosure of which is hereby incorporated by reference herein.

FIELD OF THE INVENTION

The present invention generally relates to an image forming system, an insertion method, and an insertion control program, and particularly, to an image forming system to form images on an envelope as well as on an enclosure and to insert the enclosure into the envelope, an insertion method therefor, and an insertion control program therefor.

BACKGROUND OF THE INVENTION

There are insertion systems that include an image forming apparatus to form images on envelopes as well as on sheets to be inserted into the envelopes (hereinafter "enclosure") and an insertion device to automatically insert the enclosures into the envelopes. For example, JP-2004-045650-A proposes a printing unit that includes first and second image forming units to form images on enclosures and envelopes, respectively. Specifically, the first image forming unit is disposed beneath an image reading unit and forms images electrophotographically on predetermined recording sheets fed by a sheet feeding unit, thus forming "quotations" as enclosures. The second image forming unit is disposed above a sheet processing unit and includes an enveloper feeder. The second image forming unit forms images on envelopes fed by the envelope feeder.

In this system, enclosures on which the first image forming unit has formed images are automatically inserted into envelopes on which recipients' addresses have been printed by the second image forming unit so that the contents of the envelopes correspond to the recipients.

The above-described method, however, has the following drawback because the image data size can be significantly different between the images formed by the first image forming unit and those formed by the second image forming unit. Typically, the size of images formed on enclosures is significantly greater than the size of images formed on envelopes. In insertion systems, typically the first image forming unit is provided in the image forming apparatus, and the second image forming unit is provided to the sheet processing unit, that is, a post-processing device, which is communicably connected to the image forming apparatus. The printed enclosure is transported from the image forming apparatus to the sheet post-processing device and inserted into the envelope kept open.

In this case, the time required for image formation by the image forming unit is different from that by the second image forming unit in proportional to the differences in data size. Accordingly, the timing at which conveyance of the enclosure is started must be determined considering differences in image formation time as well as differences in the length of conveyance route. Improper conveyance timing can cause defective insertion or jamming of enclosures or envelopes.

BRIEF SUMMARY OF THE INVENTION

In view of the foregoing, one embodiment of the present invention provide an image forming system that includes an enclosure supply device to transport sheets of recording media from an enclosure container, a first image forming unit to form an image on the sheet, an envelope supply device to transport envelopes from an envelope container, a second image forming unit to form an image on the envelope, an input device to input an insertion job, an insertion device to insert into the envelope at least one sheet on which the first image forming unit has formed the image, and a controller to communicably connected to the first image forming unit, the second image forming unit, the input device, and the insertion device. The insertion device includes a temporary storage tray and an envelope retainer to hold the envelope at an insertion position where the sheets are inserted into the envelope. The sheets on which the images have been formed by the first image forming unit are temporarily stored on the temporary storage tray until all the sheets inserted into a single envelope reach the temporary storage tray. The input device includes an image setter to specify the image formed on the enclosure and the image formed on the envelope for each insertion job. The controller causes the second image forming unit to complete image formation on the envelope and conveyance of the envelope to the insertion position before a last sheet of the multiple sheets inserted into the envelope reaches the temporary storage tray.

Another embodiment provides an insertion method including a step of forming an image on an image on a sheet of recording media, a step of temporarily storing on a temporary storage tray the sheet on which the first image forming unit has formed the image until all of multiple sheets inserted into a single envelope reaches the temporary storage tray, a step of forming an image on the envelope and conveying the envelope to the insertion position before a last sheet of the multiple sheets inserted into the single envelope reaches the temporary storage tray, a step of retaining the envelope at an insertion position where the sheet is inserted into the envelope, and a step of inserting, into the envelope, the sheet multiple sheets into the envelope,

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
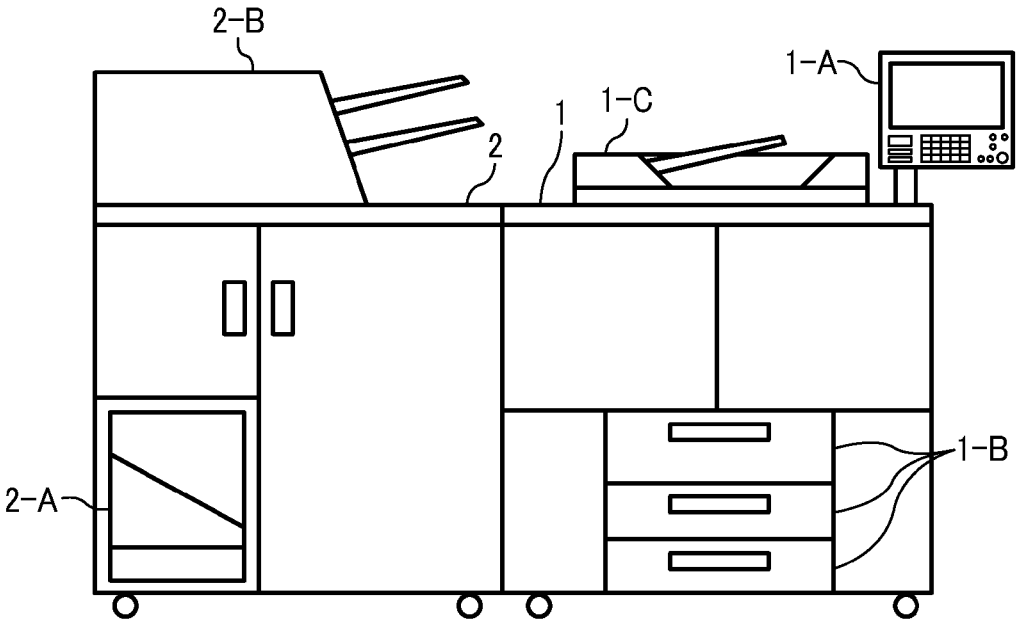
FIG. 1 is a diagram illustrating a configuration of an image forming system according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming system according to an embodiment of the present invention is described.

FIG. 1 is a front view illustrating a configuration of an image forming system according to an embodiment of the present invention serving as a sheet (in particular, recording-media sheet) processing system. In FIG. 1, the image forming system according to the present embodiment includes an image forming apparatus 1 and an insertion device or enclosing device 2. The image forming apparatus 1 includes a Multi Function Peripheral (MFP) as a main body and can serve as both a first image forming unit and an enclosure supply device. An automatic document feeder (ADF) 1-C and an operation panel 1-A including a display 900 (shown in FIG. 15) are provided above the MFP, and multiple sheet cassettes 1-B are provided beneath the MFP. The MFP includes an electrophotographic image forming unit to form images on sheets of recording media (enclosures) inserted into envelopes. The image forming unit can be either a single color image forming unit or a tandem multicolor image forming unit. Various known image forming engines can be used as the image forming unit, and description thereof are omitted.

In the configuration shown in FIG. 1, envelopes are contained in a separate device connected to the image forming apparatus 1 and disposed downstream from the image forming apparatus 1. The image forming system shown in FIG. 1 further includes a printing and feeding unit 2-B disposed above the insertion device 2 and capable of storing envelopes. One of the multiple sheet cassettes 1-B can store sheets of recording media to be inserted in the envelopes (hereinafter also "enclosures"). To insert the enclosures into the envelopes in this system, the enclosures are transported from the image forming apparatus 1 to the insertion device 2, and the envelopes are transported from the printing and feeding unit 2-B to the insertion device 2. The insertion device 2 inserts the enclosures into the respective envelopes, after which the envelopes are discharged onto a stack tray 2-A. It is to be noted that, although envelopes are stored in the printing and feeding unit 2-B, whereas enclosures are stored in the sheet cassette 1-B of the image forming apparatus 1, the items contained in the printing and feeding unit 2-B and the sheet cassette 1-B may be reversed.

Figure 2:
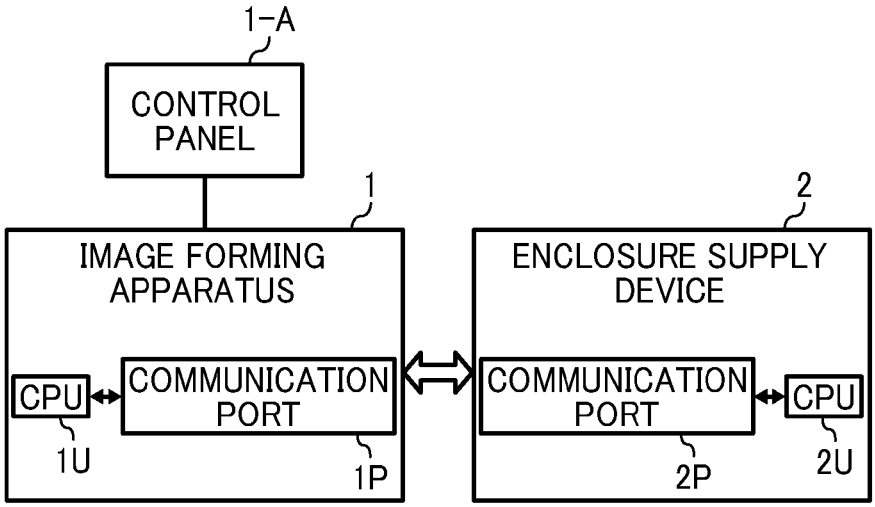
FIG. 2 is a block diagram illustrating a schematic configuration of an online control system of the image forming system shown in FIG. 1.

FIG. 2 is a block diagram illustrating a schematic configuration of an online control system of the image forming system shown in FIG. 1. In the online image forming system shown FIG. 2, the image forming apparatus 1 and the insertion device 2, which is communicably connected to the image forming apparatus 1, include central processing units (CPUs) 1U and 2U, respectively. Additionally, the image forming apparatus 1 and the insertion device 2 respectively include communication ports 1P and 2P and can communicate with each other via the communication ports P1 and 2P. The operation panel 1-A is connected to the MFP of the image forming apparatus 1 via an interface (I/F) not shown and displays various indications such as those shown in FIGS. 24, 25, and 27, instructed by the CPU 1U. Users can input instructions or data to the image forming apparatus 1 by pressing keys on the operation panel 1-A or touching the display 900.

Each of the image forming apparatus 1 and the insertion device 2 further includes a read-only memory (ROM) and a random-access memory (RAM). Each of the CPUs 1U and 2U reads out program codes from the ROM, runs the program codes in the RAM, and then performs operations defined by the program codes using the RAM as a work area and a data buffer. With this configuration, the display and operations described above or below are controlled.

The apparatus and the device are connected in series electrically via the communication ports 1P and 2P as well as mechanically via at least a sheet conveyance path. Thus, when the image forming system operates online, the image forming apparatus 1 and the insertion device 2 can be controlled electrically simultaneously. The processes in the flowcharts shown in FIG. 23, described later, are instructed by the CPU 1U and executed by the respective apparatuses and the device.

Figure 3:
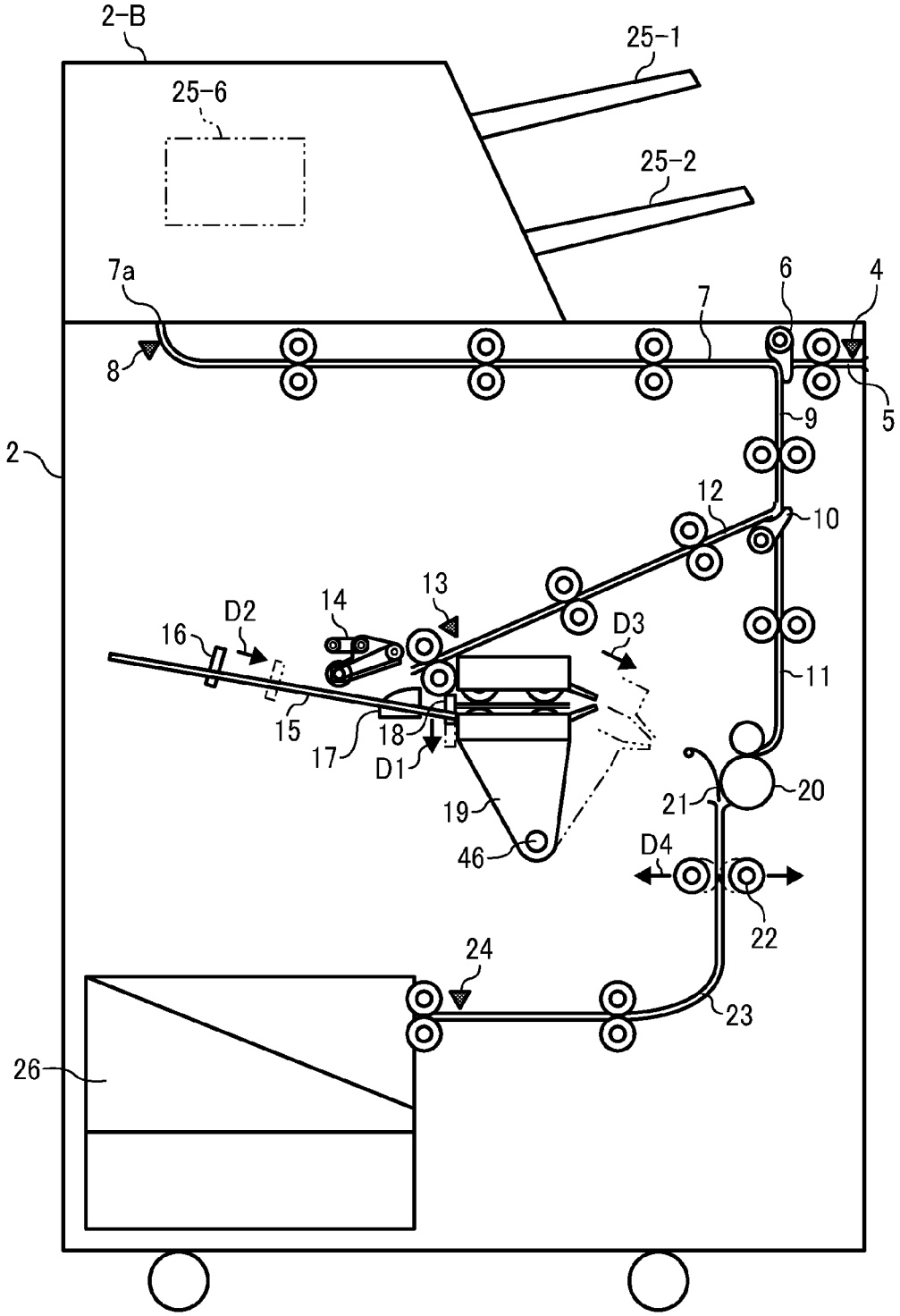
FIG. 3 illustrates an interior of an insertion device according to an embodiment.

FIG. 3 illustrates an interior of the insertion device 2 according to the present embodiment. It is to be noted that, in FIG. 3. reference numeral 21 represents an unsealing sheet.

The printing and feeding unit 2-B includes feeding cassettes 25-1 and 25-2 for containing envelopes and an image forming unit 25-6. It is to be noted that that the insertion device 2 and the printing and feeding unit 2-B can be regarded as an integrated insertion unit including a second image forming unit, the insertion device, and an envelope supply device provided with an envelope container.

In the printing and feeding unit 2-B, the envelopes stored in the feeding cassettes 25-1 and 25-2 are fed to the image forming unit 25-6, where recipients' addresses are printed on the envelopes with, for example, an ink-ejecting head, and then the envelopes are conveyed to a main body of the insertion device 2. The envelope enters the insertion device 2 from an envelope inlet 7*a* of a conveyance path 7, and an envelope entry detector 8 detects the envelope. Then, the respective conveyance rollers are driven, thus starting conveyance of the envelope. A pivotable upper separation pawl 6 is provided at a bifurcation position from which the conveyance path 7 bifurcates into a lower conveyance path 9 and an entrance path 5. When the upper separation pawl 6 is at a position shown in FIG. 3, the envelope is guided to the lower conveyance path 9. The envelope transported horizontally along the conveyance path 7 is then transported vertically along the lower conveyance path 9.

Additionally, a pivotable lower separation pawl 10 is provided at a bifurcation position from the lower conveyance path 9 between a vertical conveyance path 11 and an enclosure conveyance path 12. To guide the envelope, the lower separation pawl 10 pivots counterclockwise in FIG. 3 to a position to open the vertical conveyance path 11. Thus, the envelope is guided to the vertical conveyance path 11.

A pair of chuck rollers 20 and 36, provided extreme downstream in the vertical conveyance path 11 clamps a gusset of the envelope, retaining the envelope there, and waits for the enclosure. At this time, the pivotable rollers 22 are withdrawn from the envelope in the directions indicated by arrows D4 not to contact the envelope.

In the image forming apparatus 1, an image reading unit reads image data of an original document sent by the ADF 1-C, and then a sheet sized corresponding to the size of the original document is fed from the sheet cassette 1-B to the MFP. After an image is formed on the sheet, the sheet is transported to the insertion device 2. The enclosure is discharged from a sheet outlet formed in an upper portion of the image forming apparatus 1 and is transported to the entrance path 5 of the insertion device 2. After an entry detector 4 detects the enclosure, the conveyance rollers are driven and start transporting the enclosure.

At that time, the upper separation pawl 6 pivots clockwise from the position shown in FIG. 3 to guide the enclosure to the lower conveyance path 9, blocking the conveyance path 7. Then, the enclosure, which has been transported horizontally, is transported vertically along the lower conveyance path 9. At that time, the lower separation pawl 10 has pivoted down from the position shown in FIG. 3 to guide the enclosure to the enclosure conveyance path 12. The enclosure passes by an enclosure detector 13 and is stacked on a temporary storage tray 15. Subsequently, a return roller 14 moves to a position in contact with the temporary storage tray 15 and transports the enclosure toward a back stopper 18. Further, a pair of side joggers 17 aligns the enclosure. This operation is repeated until all the sheets inserted into an identical envelope as enclosures are aligned on the temporary storage tray 15.

After a bundle of enclosures transported one by one from the image forming apparatus 1 are stacked on the temporary storage tray 15, the back stopper 18 is withdrawn in the direction indicated by arrow D1. A front stopper 16 starts moving in the direction indicated by arrow D2 to a position indicated by broken lines and transports the bundle of enclosures inside a pack unit 19. Then, the bundle of enclosures is clamped in nips between upper rollers 42 and lower rollers 43, arranged vertically (shown in FIG. 11), in the pack unit 19. After the enclosures are transported therein, the pack unit 19 pivots about a support point 46 in the direction indicated by arrow D3 shown in FIG. 3. Then, a single enclosure or multiple enclosures to be inserted into a single envelope are transported by the upper rollers 42 and the lower rollers 43 of the pack unit 19 into the envelope retained by the pair of chuck rollers 20 and 36 (shown in FIG. 10). After the enclosures are put in the envelope, the pivotable rollers 22 move in the direction opposite to the directions indicated by arrow D4, respectively, and start transporting the envelope to a discharge path 23. The envelope is transported through the discharge path 23, passes by an envelope detector 24, and is stacked on an envelope tray 26.

Figure 4:
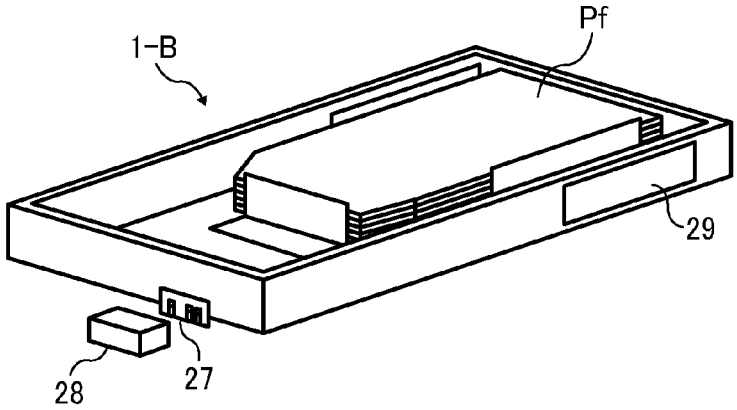
FIG. 4 is a perspective view that illustrates a feed cassette of an image forming apparatus and a size detecting system to detect the size of the envelope or enclosure stored in the feed cassette.

FIG. 4 is a perspective view that illustrates the sheet cassette 1-B of the image forming apparatus 1 and a size detecting system to detect the size of the envelope or enclosure stored in the sheet cassette 1-B. In FIG. 4, a planar size indicator 27 is attached to each sheet cassette 1-B. Each size indicator 27 is sized according to the size of the sheets or envelopes contained therein. The main body of the image forming apparatus 1 includes a size detector 28 corresponding to each size indicator 27. When the sheet cassette 1-B is set in the main body, the size detector 28 detects the size indicator 27 and thus recognizes the size of sheets or envelopes (in FIG. 4, envelopes Pf) contained in the sheet cassette 1-B. Additionally, a size sticker 29 (i.e., a size label) is attached to a side face of the sheet cassette 1-B so that the user can recognize the size or type of objects contained therein.

Figure 5:
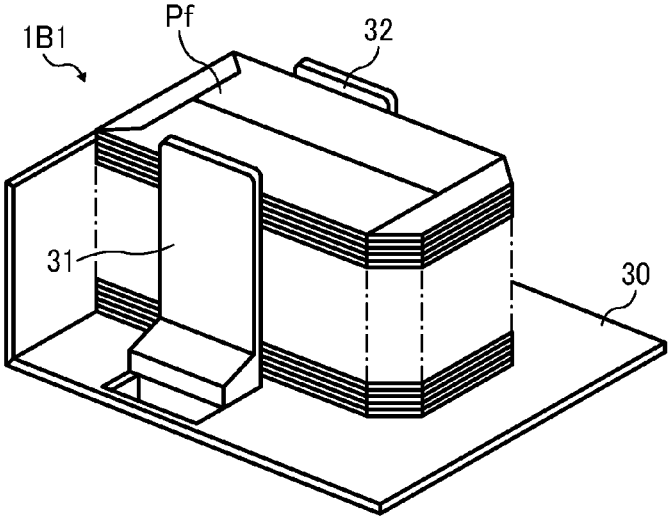
FIG. 5 is a perspective view that illustrates a variation of the feed cassette and the size detecting system.
Figure 6:
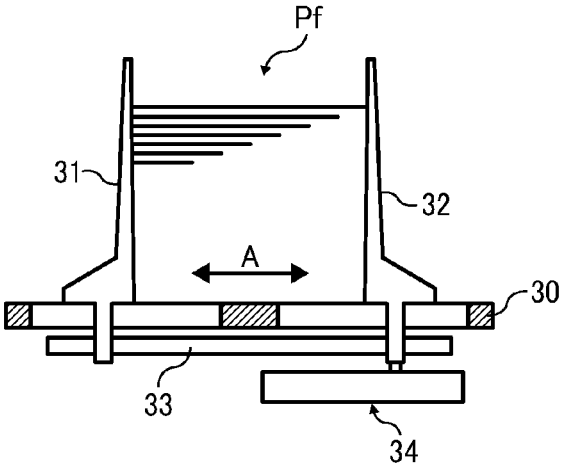
FIG. 6 is a cross-sectional view of the feed cassette and the size detecting system shown in FIG. 5.

FIGS. 5 and 6 are a perspective view and a cross-sectional view, respectively, that illustrate a variation of the sheet cassette 1-B and the size detecting system to detect the size of the envelope or enclosure stored therein.

A sheet cassette 1B1 shown in FIGS. 5 and 6 includes a bottom plate 30 on which the envelopes Pf are stacked and a pair of side guides 31 and 32 slidable in a direction indicated by arrow A shown in FIG. 6, along a guide rod 33. The envelopes Pf are set in a center portion of the bottom plate 30, pushed by the side plates 31 and 32. Additionally, a size detector 34 is provided beneath the bottom plate 34. The size detector 34 detects the position of the side guide 32 to detect the size of the objects (in FIGS. 5 and 6, envelopes Pf) stacked on the bottom plate 30. More specifically, the size detector 34 compares the detected position of the side guide 32 with size data stored preliminarily therein and thus recognizes the size of the sheets or the envelopes Pf set on the bottom plate 30. For example, a variable-resistance position detector can be used as the size detector 34. The CPU 1U can easily detect the size of the objects contained in the sheet cassette 1B1 based on the resistance value output by the variable-resistance type position detector or changes in the resistance.

Figure 7:
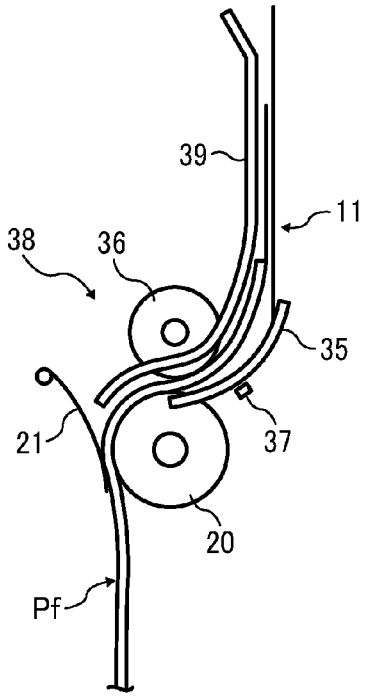
FIG. 7 is a cross-sectional view that illustrates a main portion of an envelope chuck unit in the insertion device.

FIG. 7 is a cross-sectional view that illustrates a main portion of the envelope chuck unit 38 in the insertion device 2.

In FIG. 7, the lower chuck roller 20 and the upper chuck roller 36, provided extreme downstream in the vertical conveyance path 11, together form an envelope chuck unit 38. The chuck rollers 20 and 36 are arranged substantially vertically in FIG. 7 and can rotate while pressing against each other, forming a nip portion therebetween. The chuck rollers 20 and 36 may be rollers, cones, or spheres. Envelope guides 35 and 39 to guide the envelope Pf to the nip portion between the chuck rollers 20 and 36 are provided upstream from the chuck rollers 20 and 36 in the vertical conveyance path 11 in the direction in which the envelope is transported (hereinafter "envelope conveyance direction"). An envelope detector 37 is provided on an upstream side of the nip portion in the envelope conveyance direction. The unsealing sheet 21 in contact with the lower chuck roller 20 is formed of a plastic sheet such as Mylar® and can deform elastically. The unsealing sheet 21 is provided at such a position that a part of the unsealing sheet 21 can enter an opening Pon (shown in FIG. 8) of the envelope Pf supported by the chuck rollers 20 and 36, thereby unsealing the envelope Pf.

The chuck rollers 20 and 36 are arranged substantially vertically and pressed against each other. The envelope guides 35 and 39 guide the envelope Pf from the vertical conveyance path 11 to the nip portion between the chuck rollers 20 and 36 and further downward from the nip portion between the chuck rollers 20 and 36 along a circumferential surface of the lower chuck roller 20.

The unsealing sheet 21 may be a thin resin film member and positioned adjacent to the lower chuck roller 20. An upper side of the unsealing sheet 21 is fixed, and, in an ordinary state, a portion of the unsealing sheet 21 adjacent to a lower end portion 21*a* (shown in FIG. 8) thereof is pressed against the lower chuck roller 20 with a predetermined pressure due to the elasticity of the material of the unsealing sheet 21.

Figure 8:
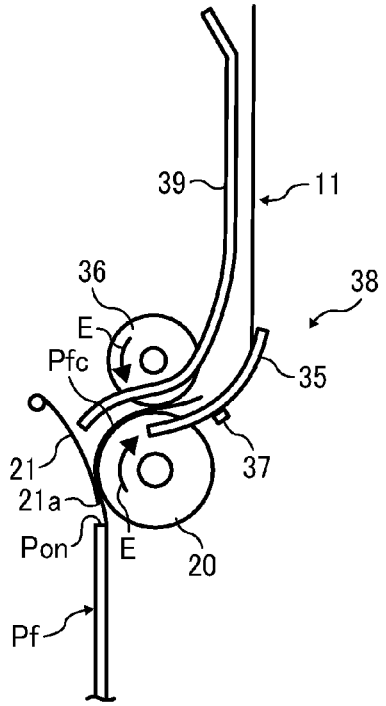
FIG. 8 is a cross-sectional view that illustrates the main portion of the envelope chuck unit, in which an opening of the envelope is positioned beneath a lower end of an unsealing sheet.
Figure 9:
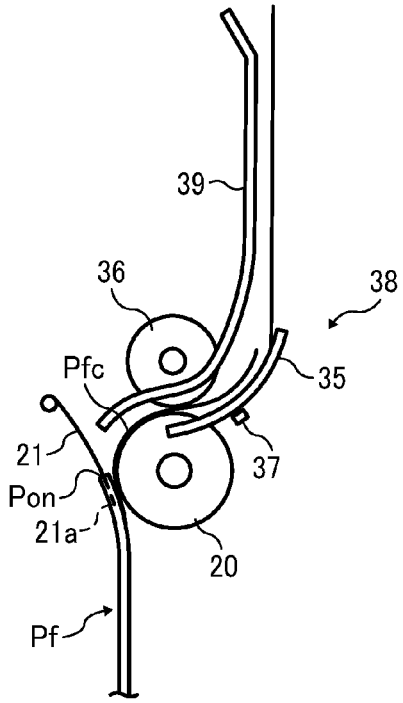
FIG. 9 is a cross-sectional view that illustrates the main portion of the envelope chuck unit, in which the lower end of the unsealing sheet is in the envelope.

FIG. 8 is a cross-sectional view of the main portion of the envelope chuck unit 38 and illustrates a state in which the opening Pon of the envelope Pf is positioned beneath the lower end portion 21*a* of the unsealing sheet 21. FIG. 9 is another cross-sectional view of the main portion of the envelope chuck unit 38, and the lower end portion 21*a* of the unsealing sheet 21 is in the envelope Pf in FIG. 9.

In the envelope chuck unit 38, the envelope guides 35 and 39 guide the envelope Pf to the nip portion between the chuck rollers 20 and 36 when the envelope Pf is transported downward in FIG. 8. Subsequently, the chuck rollers 20 and 36 rotate and transport the envelope Pf between the chuck roller 20 and the unsealing sheet 21. When the sheet or enclosure is guided into the envelope Pf, the envelope Pf is stopped at such a position that a flap Pfc of the envelope Pf is clamped by the chuck rollers 20 and 36 as shown in FIG. 8. More specifically, when the envelope detector 37 detects passage of an end of the flap Pfc of the envelope Pf, the CPU 2U stops a driving motor that drives the chuck rollers 20 and 36, thus stopping the envelope Pf. At that time, the opening Pon of the envelope Pf is positioned lower than the lower end portion 21*a* of the unsealing sheet 21.

Figure 10:
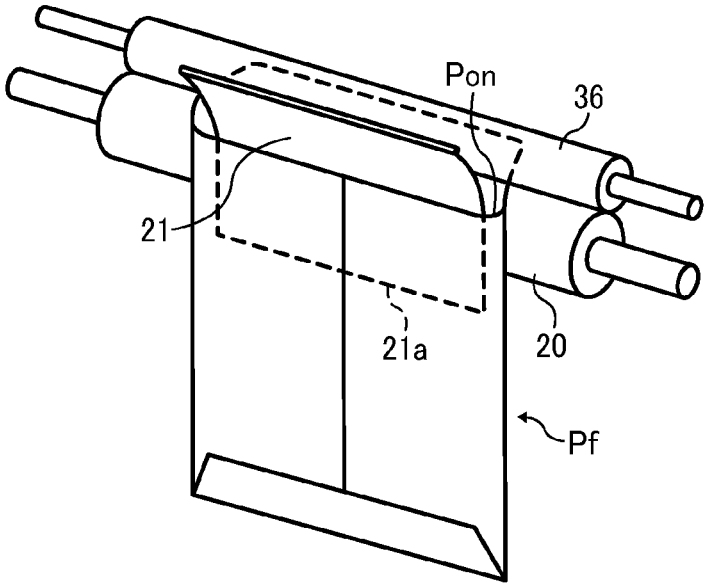
FIG. 10 is a cross-sectional view that illustrates the envelope chuck unit in which the lower end of the unsealing sheet is in the envelope.

Subsequently, the CPU 2U rotates the chuck rollers 20 and 36 in reverse, which is the direction indicated by arrow E shown in FIG. 8. Thus, the envelope Pf is switchbacked and transported upward in the vertical conveyance path 11. At that time, because the lower side of the unsealing sheet 21 is in contact with the flap Pfc of the envelope Pf due to its elasticity, the lower end portion 21*a* of it enters the opening Pon of the envelope Pf as shown in FIG. 9. The reverse rotation of the chuck rollers 20 and 36 is stopped in this state, and upward conveyance of the envelope Pf is stopped. FIG. 10 is a perspective view illustrating this state, and the envelope Pf is opened by the lower end portion 21*a* of the unsealing sheet 21 that is in the opening Pon of the envelope Pf.

Figure 11:
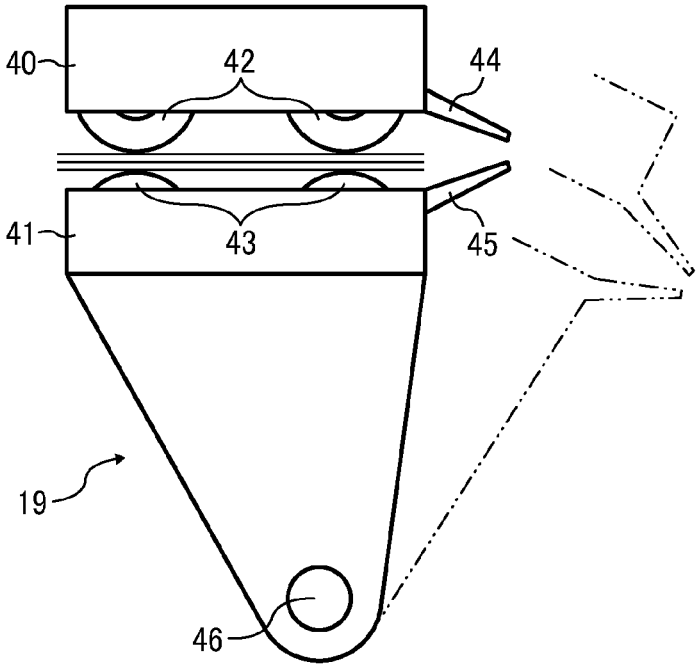
FIG. 11 is a front view of a pack unit of the insertion device.

FIG. 11 is a front view of the pack unit 19 of the insertion device 2. In the configuration shown in FIG. 11, the pack unit 19 includes an upper pack portion 40 and a lower pack portion 41, and the upper rollers 42 and the lower rollers 43 are rotatively attached to the upper pack portion 40 and a lower pack portion 41, respectively. Additionally, entry guides 44 and 45 are respectively provided on right end portions of the upper pack portion 40 and the lower pack portion 41 in FIG. 11. Base ends (proximal ends) of the entry guides 44 and 45 are rotatively supported by the upper pack portion 40 and the lower pack portion 41, respectively, and distal end sides of the entry guides 44 and 45 are biased toward each other by springs with a relatively small pressure, respectively. With this configuration, when a bundle of enclosures passes between the entry guides 44 and 45, the entry guides 44 and 45 are pushed away from each other. Thus, the resistance that the bundle of enclosures receives can be lower when the bundle is transported.

The pack unit 19 pivots about the support point 46 supporting the pack unit 19, and the entry guides 44 and 45 are inserted between the flap Pfc and the unsealing sheet 21, which is on standby at the position shown in FIG. 10. In this state, the front stopper 16 moves in the direction indicated by arrow as described above, and the upper and lower rollers 42 and 43 are driven. Then, the enclosure passes between the entry guides 44 and 45 and is inserted in the envelope Pf.

Figure 12:
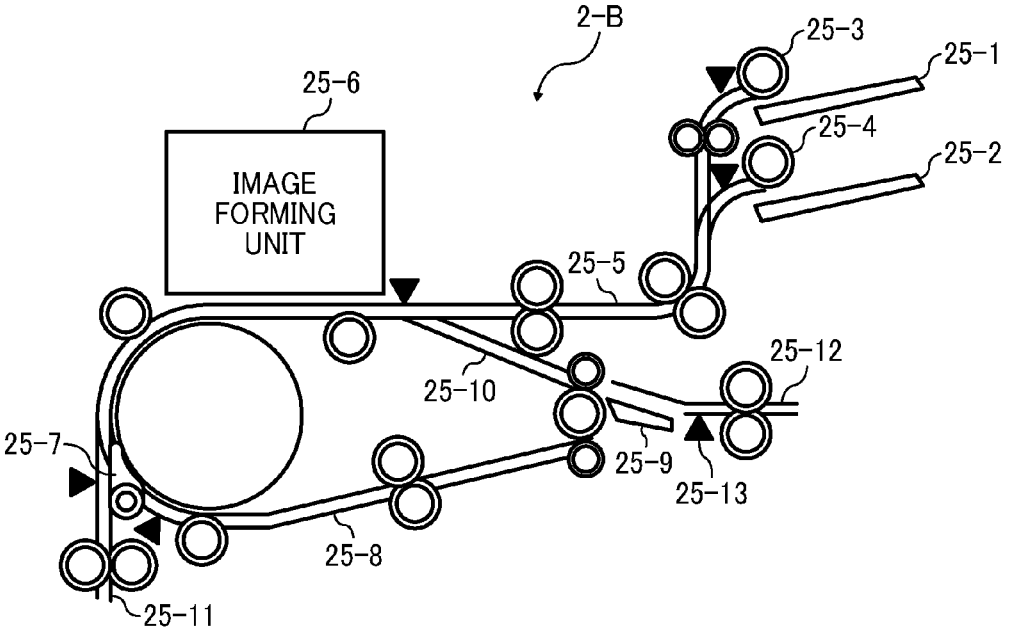
FIG. 12 illustrates an interior of a printing and feeding unit.

FIG. 12 illustrates an interior of the printing and feeding unit 2-B.

The printing and feeding unit 2-B includes the printing unit 25-6, the first and second feeding cassettes 25-1 and 25-2, first and second pickup rollers 25-3 and 25-4 provided in extreme downstream portions of the first and second feeding cassettes 25-1 and 25-2, respectively, and multiple pairs of conveyance rollers provided along conveyance paths formed in the printing and feeding unit 2-B. The conveyance paths includes a first conveyance path 25-5 through which envelopes picked up by the first and second pickup rollers 25-3 and 25-4 are transported to a second conveyance path 25-11 leading to the envelope inlet 7*a* of the insertion device 2, a reversal conveyance path formed by first and second separation pawls 25-7 and 25-9, third and fourth conveyance paths 25-8 and 25-10, and another reversal conveyance path 25-12. The image forming unit 25-6 are disposed along the first conveyance path 25-5.

In the printing and feeding unit 2-B, the envelopes stored in the first and second feeding cassettes 25-1 and 25-2 are picked up by the first and second pickup rollers 25-3 or 25-4 and conveyed through the first conveyance path 25-5 to a position facing the image forming unit 25-6 (hereinafter "printing position"), and printing is made on the envelope. When printing is made on only a single side (first side) of the envelope, the envelope on which printing has been made is conveyed through the second conveyance path 25-11 to the conveyance path 7 inside the insertion device 2.

By contrast, when printing is to be made on both sides of the envelope, the first separation pawl 25-7 changes the conveyance route from the second conveyance path 25-11 to the third conveyance path 25-8. In the third conveyance path 25-8, the second separation pawl 25-9 rotates down (counterclockwise in FIG. 12) before the envelope reaches an end portion of the third conveyance path 25-8. Then, the envelope is transported to the reversal conveyance path 25-12. The printing and feeding unit 2-B further includes a reversal detector 25-13 downstream from the second separation pawl 25-9 in the forward conveyance direction. When the trailing end of the envelope passes by the reversal detector 25-13, conveyance of the envelope is stopped, and the second separation pawl 25-9 is rotated up to the position shown in FIG. 12. Subsequently, reversal conveyance of the envelope is started. The envelope is transported through the fourth conveyance path 25-10 leading to the first conveyance path 25-5. Subsequently, when the envelope again reaches the printing position, printing is made on a second side (e.g., back side) of the envelope, after which the first separation pawl 25-7 guides the envelope to the second conveyance path 25-11. The envelope is further conveyed to the conveyance path 7 inside the insertion device 2.

Figure 13:
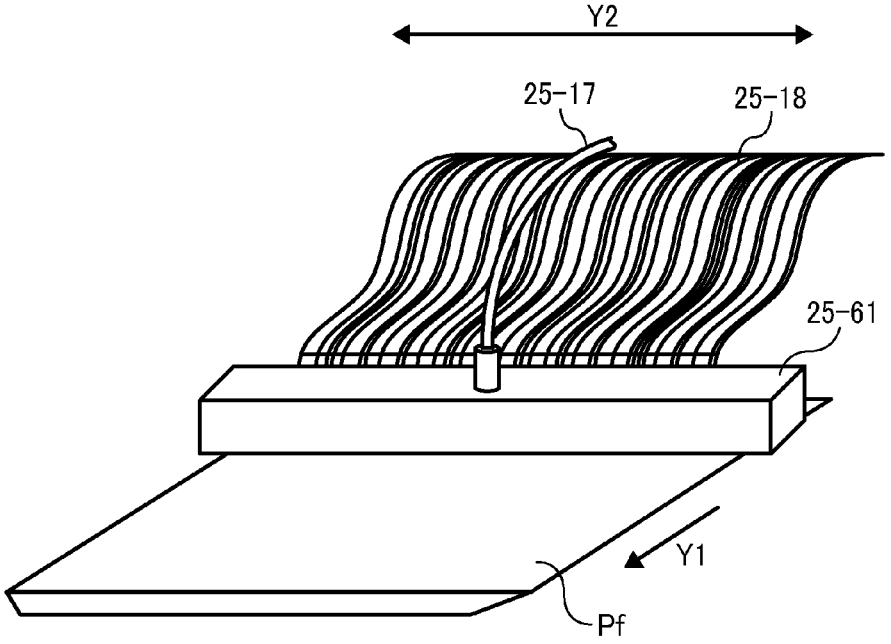
FIG. 13 is a perspective view illustrating a line ink-ejecting head serving as a second image forming unit.

FIG. 13 is a perspective view illustrating a line ink-ejecting head 25-61 as an example of an image forming mechanism of the image forming unit 25-6.

In the present embodiment, the image forming unit 25-6 includes the line ink-ejecting head 25-61 to form images in an ink-ejection method. The printing and feeding unit 2-B further includes an ink tank and an ink supply pipe 25-17 to supply ink from the ink tank to the line ink-ejecting head 25-61. In FIG. 13, the envelope Pf is transported in the direction indicated by arrow Y1 (hereinafter "conveyance direction"), and the line ink-ejecting head 25-61 has a width greater than a sheet width (i.e., width of envelopes), which is the direction indicated by arrow Y2 (hereinafter "width direction") perpendicular the conveyance direction indicated by arrow Y1. Thus, the line ink-ejecting head 25-61 can form images in the entire sheet width and need not to move in the width direction for image formation. The line ink-ejecting head 25-61 is driven by a head driver to which drive signal line 25-18 is connected for drive signal transmission from the CPU 2U. The drive signal line 25-18 is constructed of, for example, a flexible wiring board.

Figure 14A:
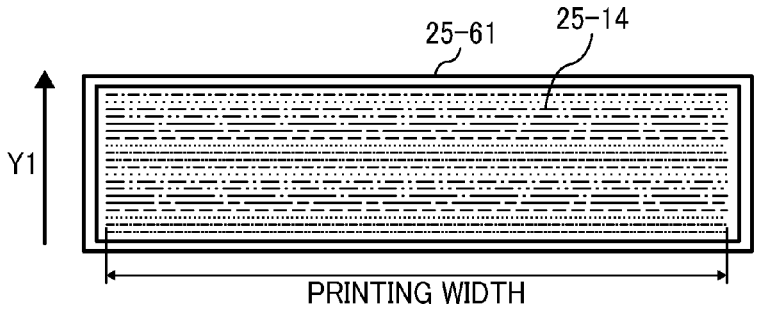
FIGS. 14A and 14B illustrate a configuration of the line ink-ejecting head.
Figure 14B:
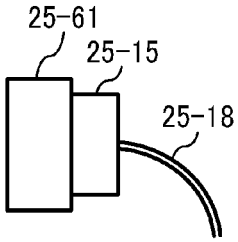

FIGS. 14A and 14B illustrate a configuration of the line ink-ejecting head 25-61; FIG. 14A is a front view thereof as viewed from a nozzle side, and FIG. 14B is a side view of the line ink-ejecting head 25-61 as viewed from the right in FIG. 14A.

Referring to FIG. 14A, the line ink-ejecting head 25-61 includes multiple nozzle lines 25-14 that extend in the width direction and are arranged in the conveyance direction indicated by arrow Y1. The density of the nozzle lines 25-14 is similar to that of images to be formed. The line ink-ejecting head 25-61 may include nozzle lines dedicated for at least three colors to perform multicolor printing. Additionally, as shown in FIG. 14B, the line ink-ejecting head 25-61 is supported by a support frame 25-15. The drive signal line 25-18 is connected to a connector on a rear side of the support frame 25-15.

Figure 15:
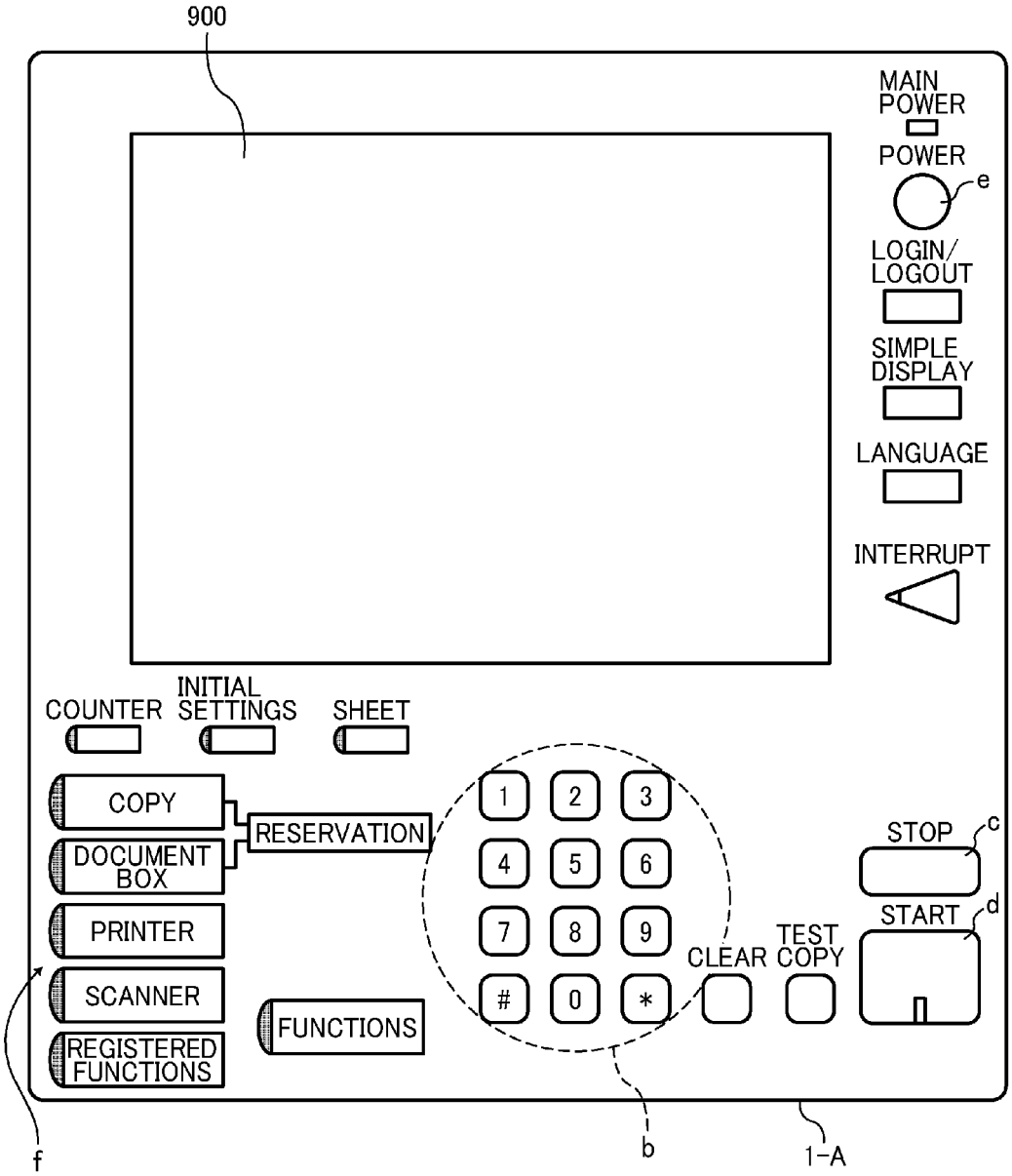
FIG. 15 is a front view of an operation panel provided on an upper face of the image forming apparatus.

FIG. 15 is a front view of the operation panel 1-A provided on an upper face of the image forming apparatus 1.

Referring to FIG. 15, the operation panel 1-A includes a display 900, a group of numeric keys b, a STOP key c, a START key d, a POWER button e, and a group of function selection keys f. The display 900 displays various messages and input keys in layers. The user can input numbers by pressing the numeric keys b. The user can stop processing by pressing the STOP key c. Pressing the START key d generates a trigger signal to start image formation. The user can turn on and off the image forming system by pressing the POWER button e. The group of function selection keys f includes keys with which the user selects copying, printing, scanning, or the like.

Figure 16:
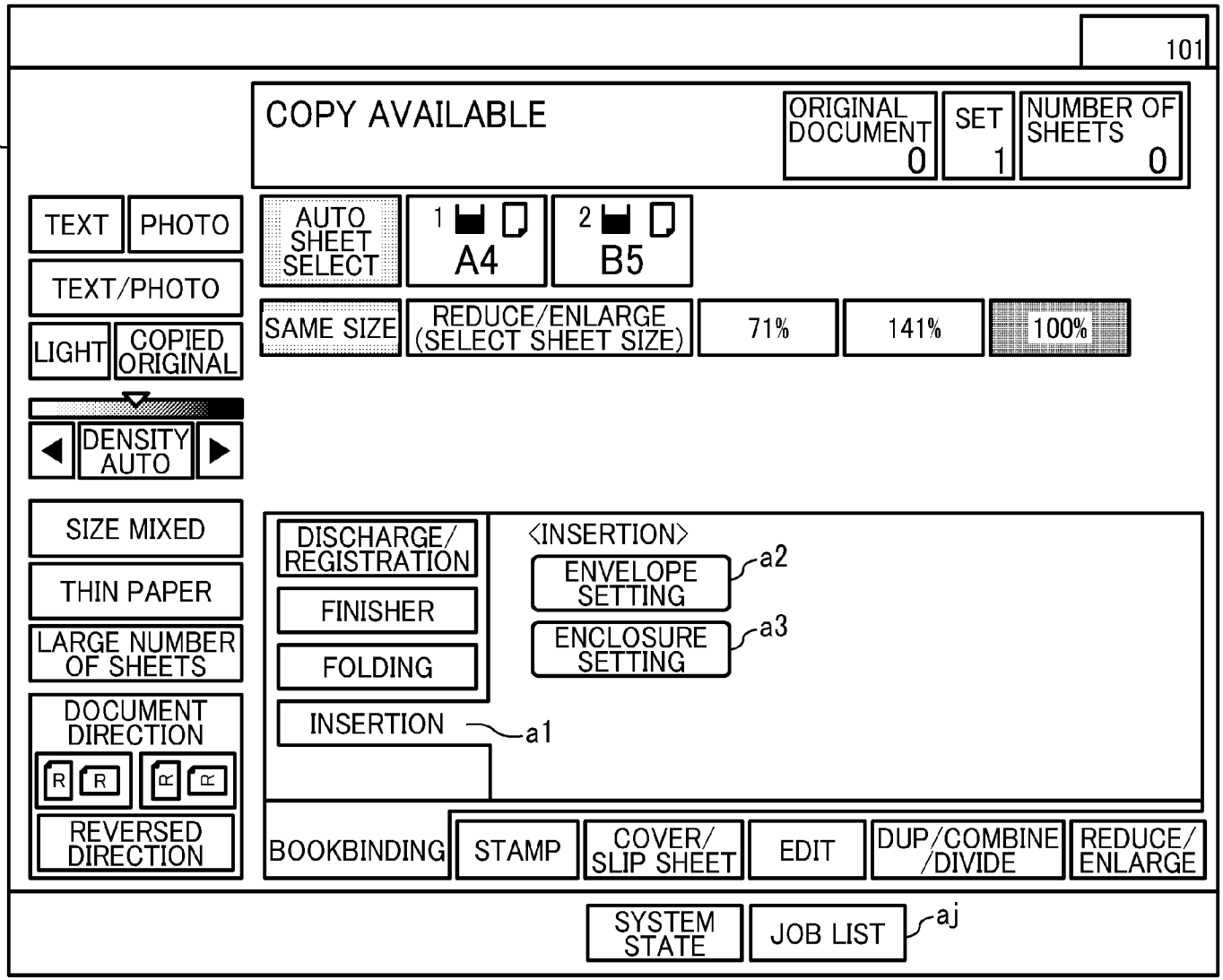
FIG. 16 illustrates indications on a display of the operation panel shown in FIG. 15.

FIG. 16 illustrates indications on the display 900 of the operation panel 1-A shown in FIG. 15. In this case, in the image forming apparatus 1, A4 size sheets are stored laterally in the first sheet cassette 1-B (hereinafter "A4Y sheets") and B5 size sheets are stored laterally in the second sheet cassette 1-B (hereinafter "B5Y sheets"). Similarly, in the printing and feeding unit 2-B, A4Y size sheets and B5Y sheets are stored in the first and second feeding cassettes 25-1 and 25-2, respectively.

For insertion of enclosures into envelopes, the user presses an INSERTION tab a1 on the display 900 shown in FIG. 16. Then, an ENVELOPE SETTING button a2 and an ENCLOSURE SETTING button a3 appear on the INSERTION tab a1. The user can set images formed on envelopes and enclosures inserted into the envelope using these buttons a2 and a3.

Figure 17:
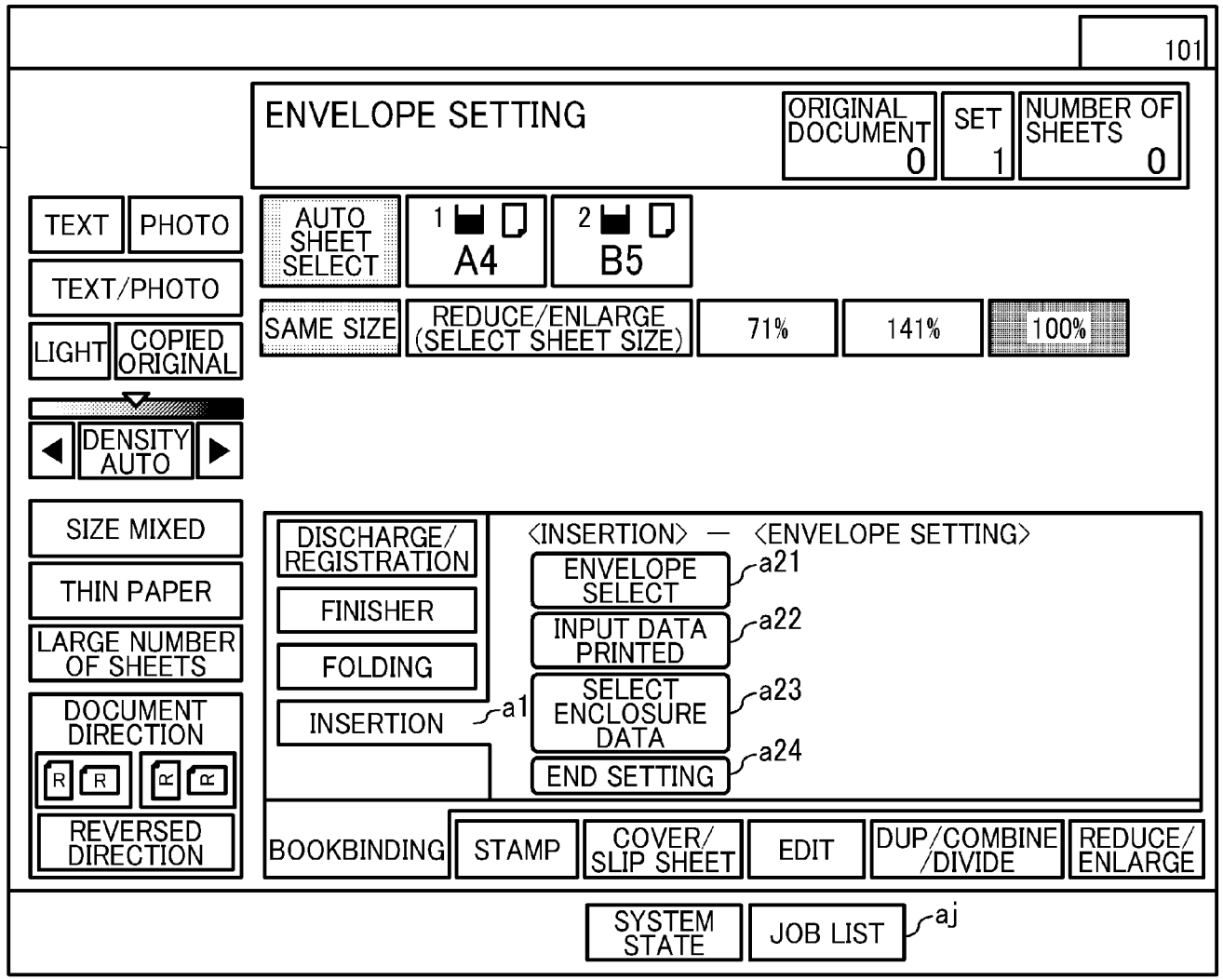
FIG. 17 is a screen display on the operation panel when an "ENVELOPE SETTING" button is pressed on the display shown in FIG. 15.

FIG. 17 is a screen display on the operation panel 1-A when the ENVELOPE SETTING button a2 is pressed on the display shown in FIG. 16. On the screen display (setting screen) shown in FIG. 17, image formation on envelopes can be set as follows. It is to be noted that setting of only typical items are described below although other image forming conditions (e.g., image density, magnification, and the like) can be set similarly to typical image forming apparatuses.

When the ENVELOPE SETTING button a2 is pressed on the screen display shown in FIG. 16, a display controller causes the display 900 to display an ENVELOPE SELECT button a21, an INPUT DATA PRINTED button a22, SELECT ENCLOSURE DATA button a23, and an END SETTING button a24. Pressing one of these buttons triggers the corresponding processing.

1) Selection of Envelopes

The user can select envelopes from those stored in the first and second feeding cassettes 25-1 and 25-2 by pressing the ENVELOPE SELECT button a21. It is to be noted that, in envelope setting, selectable items are limited to envelopes, and sheets (enclosure) are not selectable. In a default setting, envelopes contained in either the feeding cassette 25-1 or 25-2 provided above the insertion device 2 are selected. Thus, the printing and feeding unit 2-B, provided above the insertion device 2, and the image forming apparatus 1 can perform printing on the envelope and the enclosure, respectively. Accordingly, productivity can be increased.

2) Input of Image Data to be Printed

When the user presses the INPUT DATA PRINTED button a22, an input field for data such as recipient data to be printed on the envelopes appears on the top level on the screen display so that the user can input data, which is described in further detail with reference to FIG. 18. Thus, the INPUT DATA PRINTED button a22 can serve as an image setter It is to be noted that, although envelope setting is made on the control panel 1-A of the image forming apparatus 1, alternatively, envelope setting can be made from external devices such as computers connected to the image forming apparatus 1.

Figure 18:
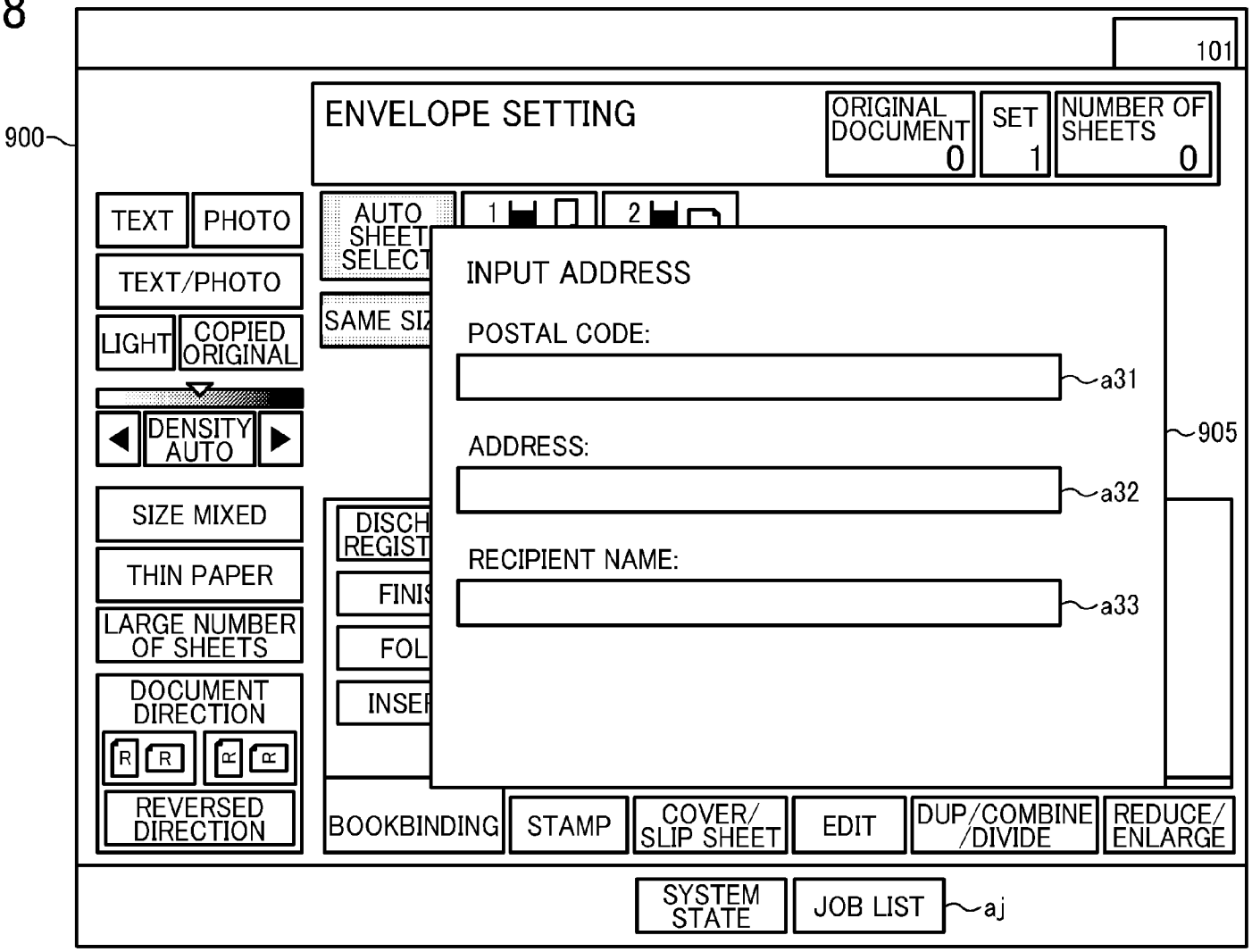
FIG. 18 is a screen display on the operation panel when a "DATA INPUT" button is pressed on the display shown in FIG. 17.

FIG. 18 is a screen display on the operation panel 1-A when INPUT DATA PRINTED button a22 is pressed on the display shown in FIG. 17. In this case, when the user presses the INPUT DATA PRINTED button a22, the display changes to that shown in FIG. 18 and an address input field 905 appears. Then, the user can input addresses as data printed on the envelope. The address input field 905 includes a POSTAL CODE field a31, an ADDRESS field a32, and a RECIPIENT NAME field a33. It is to be noted that, the data printed on envelopes further includes sender's name, postal code, and address, and the address input field 905 can further include a NOTE field.

The control circuit including the CPU 1U of the image forming apparatus 1 further include a storage device for storing the data thus input.

3) Selection of Enclosure Data

When the SELECT ENCLOSURE DATA button a23 is pressed, a selection window for selecting image data printed on the enclosure to be inserted into the envelope appears on the top level on the display 900. Thus, the envelope can be correlated with the enclosure data. Thus, the SELECT ENCLOSURE DATA button a23 can serve as another image setter.

Figure 19:
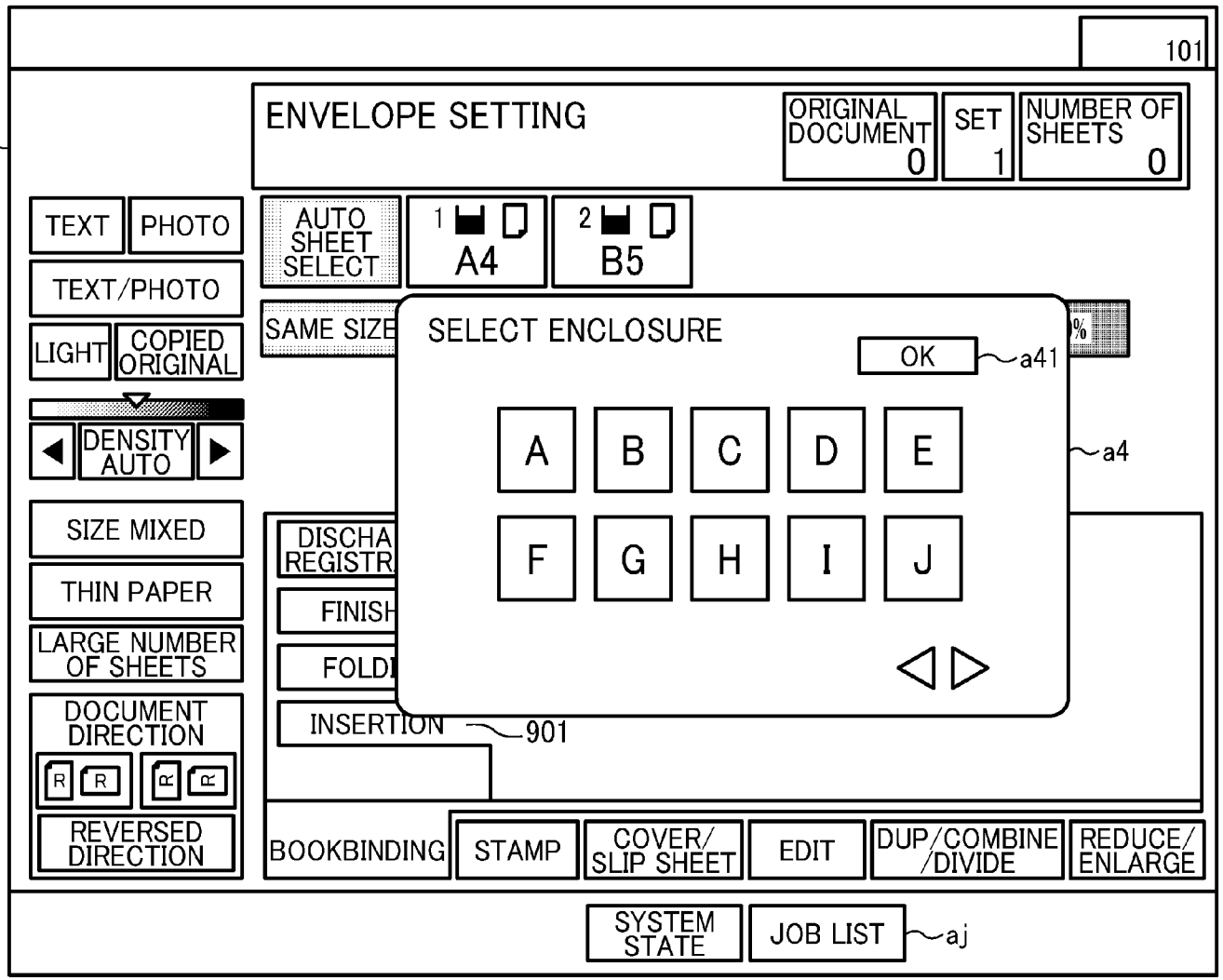
FIG. 19 is a screen display on the operation panel when an "ENCLOSURE SETTING" button is pressed on the display shown in FIG. 17.

FIG. 19 is a screen display that appears when an "SELECT ENCLOSURE DATA" button a23 is pressed on the display shown in FIG. 17.

When the user presses the SELECT ENCLOSURE DATA button a23, the display changes to that shown in FIG. 19, and an enclosure selection window a4 including a list of data printed on enclosures appears. When the image forming apparatus 1 has already acquired image data, a list of such image data (iconic images) is shown on the enclosure selection window a4. To select the enclosure to be inserted into the envelope whose recipient data has been input, the user presses one of the iconic images (e.g., A to J in FIG. 19) to be printed on the enclosure. The user can select multiple iconic images if multiple different types of enclosures are inserted into the envelope. After selection is made, the user presses an OK button a41 to confirm the selection.

Additionally, other data can be imported using an IMPORT IMAGE button 903 described below. To capture images, the user can place an original on the ADF 1-C and scan the image. Alternatively, the user can import images from computers.

4) Completion of Settings

After necessary settings are made, the user can finish the setting by pressing the END SETTING button a24 on the insertion tab a1.

Table 1 shows an example of insertion jobs (i.e., envelope setting records) stored as a table in the storage device of the image forming apparatus 1.

TABLE 1

| No. | Output order | Postal code | Address | Recipient name | Sheet cassette | Feeding cassette | Enclosure data |
|---|---|---|---|---|---|---|---|
| 1 | 1 | xxx-xxxx | Tokyo | A | A | 1 | A, B, C |
| 2 | 2 | yyy-yyyy | Kanagawa | B | A | 1 | A, , B, C, , D |
| 3 | 3 | zzz-zzzz | Ibaraki | C | A | 1 | A, B, C |
| 4 | 4 | xxx-xxxx | Tokyo | D | B | 2 | B, C |
| 5 | 5 | yyy-yyyy | Kanagawa | E | B | 2 | B, C |
| 6 | 6 | zzz-zzzz | Ibaraki | F | B | 2 | C |

The storage unit stores the input data in the order of input. This table appears on the display when the JOB LIST button aj on the bottom of the display 900 is pressed. The envelope setting records includes the followings.

The order of input is recorded in the "No." field, and the ordinal number of output (i.e., printing order) is recorded in the "output order" field. Additionally, the postal code and the address are recorded in the "postal code" field and the "address" field, respectively. Further, the recipient name is recorded in the "recipient name" field, and the identification of the sheet cassettes 1-B and the feeding cassettes 25-1 and 25-2 are recorded in the "sheet cassette" and "feeding cassette" fields, respectively. The identification data of the enclosure is recorded in the "enclosure data" field. Each record is set as an insertion job.

Figure 20:
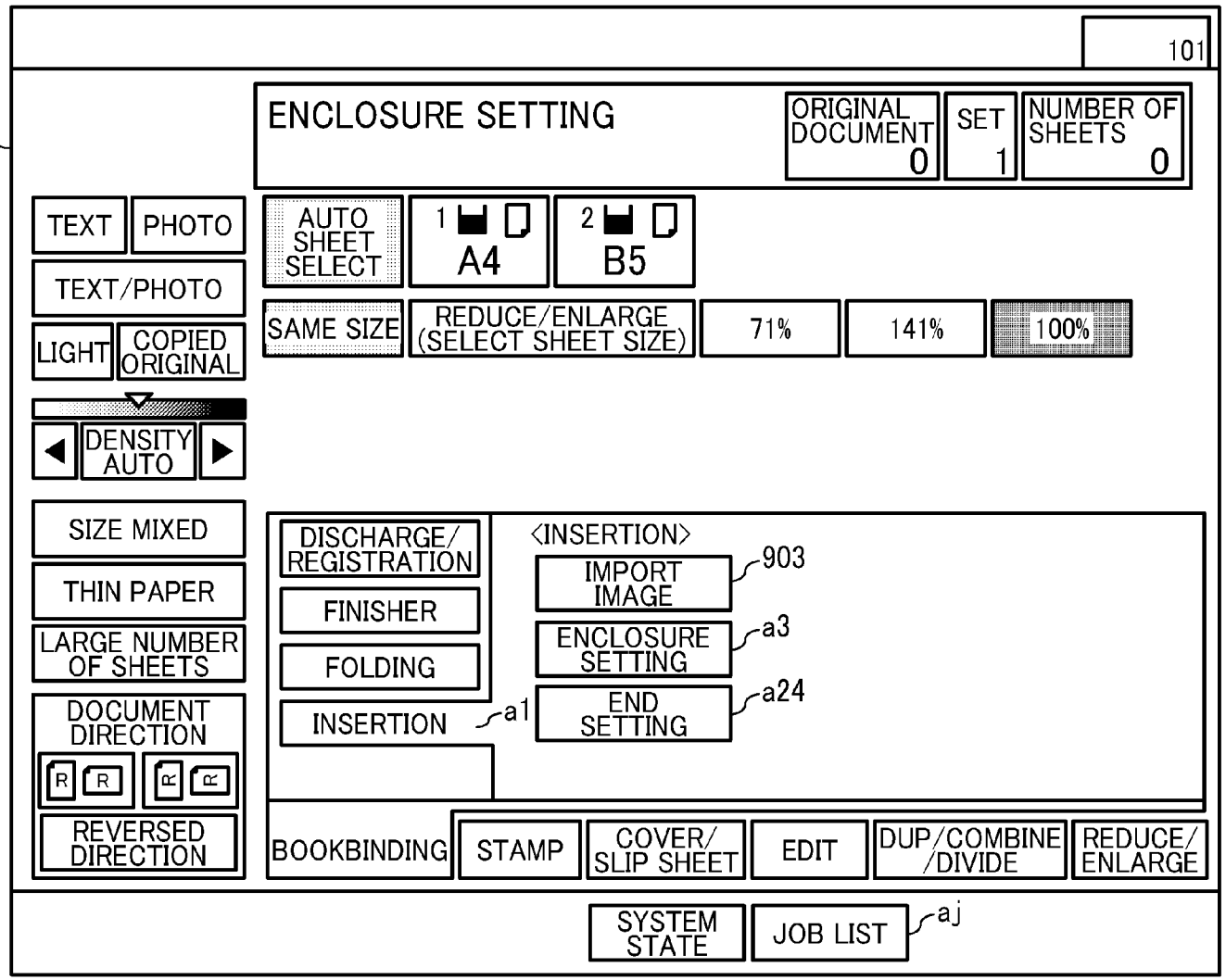
FIG. 20 is a screen display on the operation panel when an "ENCLOSURE SETTING" button is pressed on the display shown in FIG. 16.

FIG. 20 is a screen display when the "ENCLOSURE SETTING" button a3 is pressed on the display shown in FIG. 16.

In this case, it is assumed that the storage device of the image forming apparatus 1 stores data printed on the enclosures. In the enclosure setting window shown in FIG. 20, setting regarding enclosures stored in the sheet cassettes 1-B can be made.

When the ENCLOSURE SETTING button a3 is pressed on the screen display shown in FIG. 16, the display controller causes the display 900 to display the IMPORT IMAGE button 903, the ENCLOSURE SETTING button a3, and the END SETTING button a24 on the insertion tab. Pressing one of these buttons triggers the corresponding processing.

1) Import of Images

Images printed on the enclosure can be imported using the IMPORT IMAGE button 903. To capture images, the user can place an original on the ADF 1-C and scan the image. Alternatively, the user can import images from computers.

2) Enclosure Setting

Figure 21:
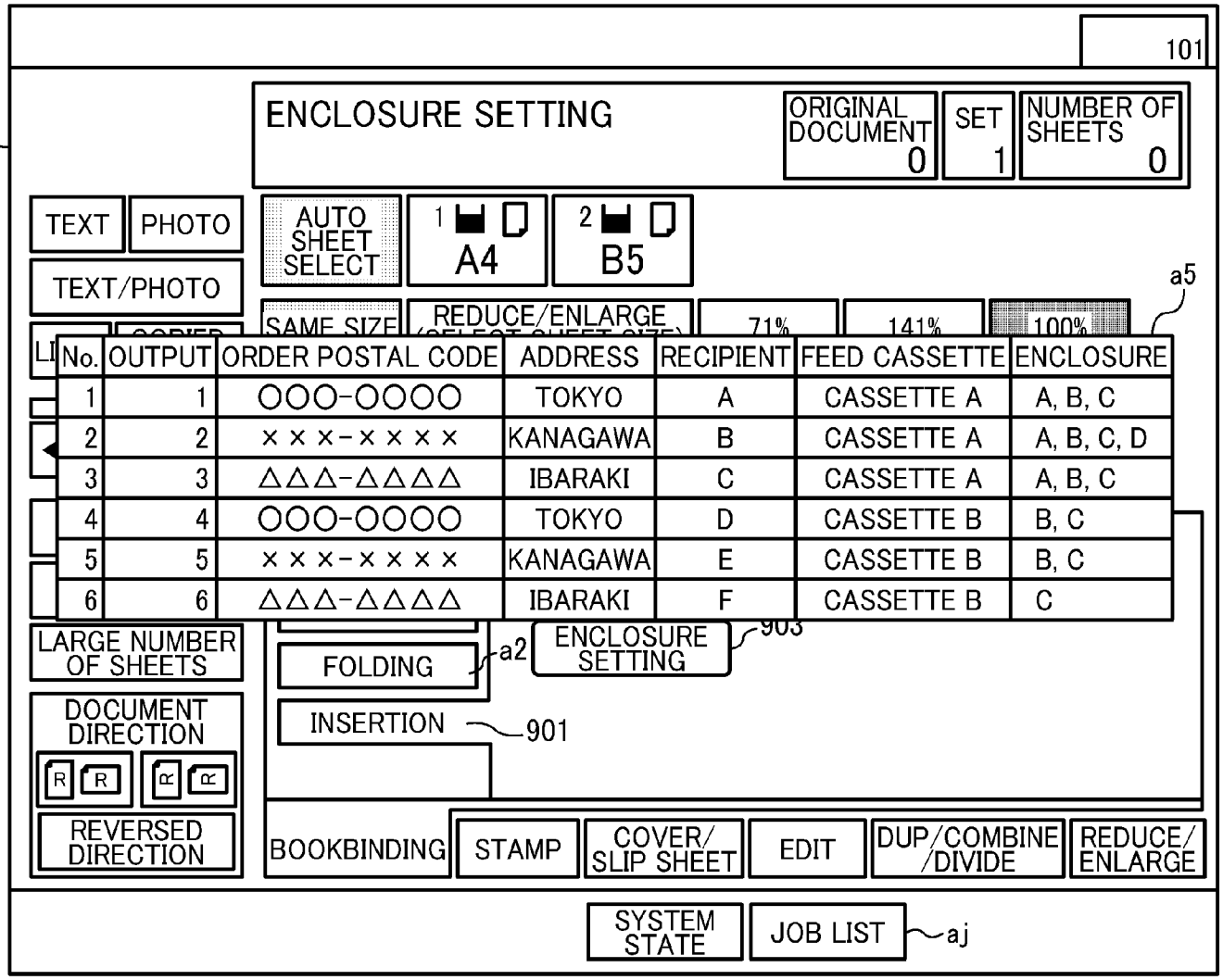
FIG. 21 illustrates an enclosure setting window in which a list of jobs inputted in envelope setting is shown.

The user presses the ENCLOSURE SETTING button a3 to make settings regarding the enclosure. When the ENCLOSURE SETTING button a3 is pressed on the screen display shown in FIG. 20, the display changes to that shown in FIG. 21, and the list of jobs input is shown in an enclosure data setting window a5. The user can make enclosure setting in detail by pressing the enclosure data field of each job.

Figure 22:
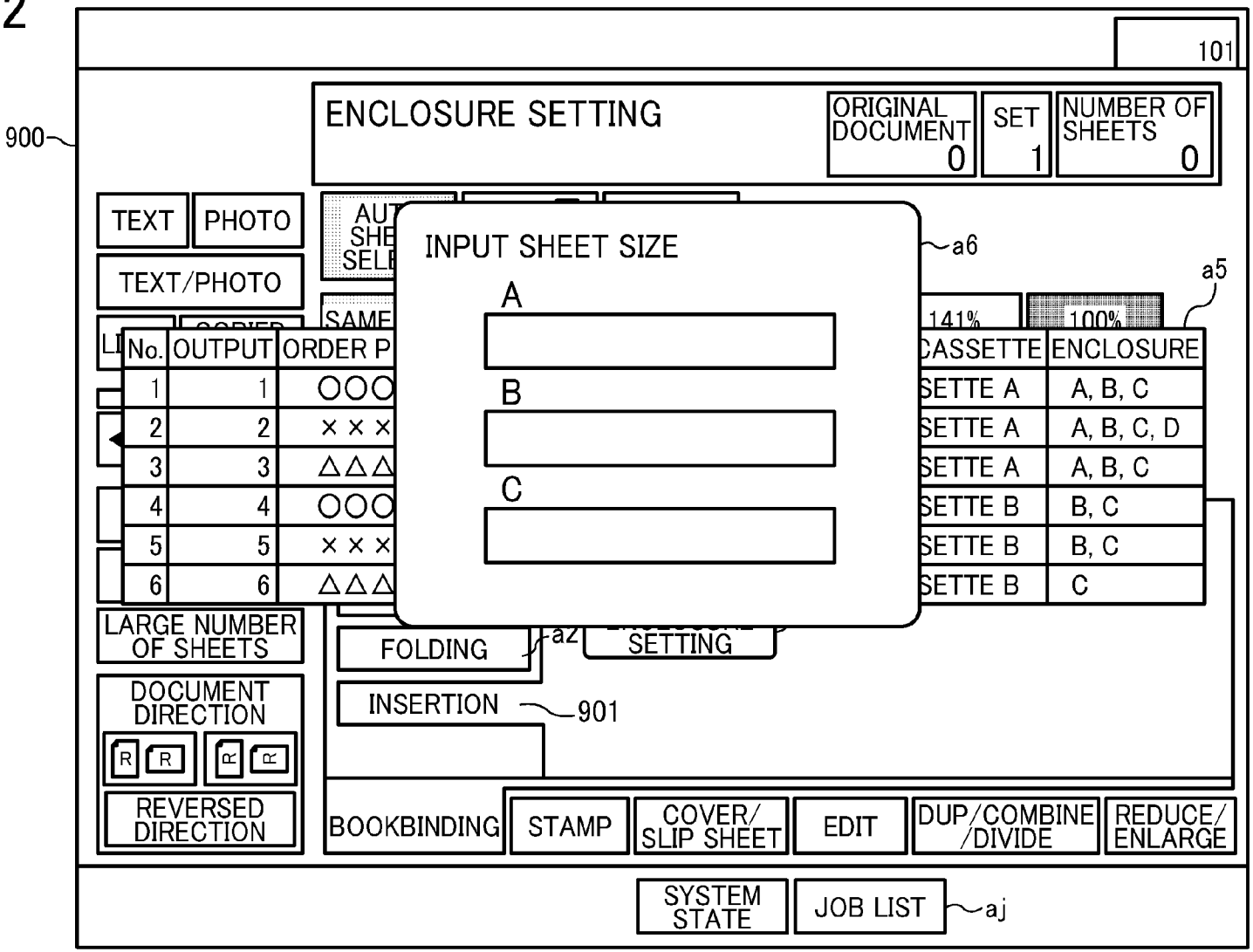
FIG. 22 illustrates a sheet size input window, which appears when an "enclosure data" field of the record No. 1 or 3 is pressed on the enclosure data setting window.

FIG. 22 illustrates a sheet size input window a6, which appears when the "enclosure data" field of the record No. 1 or 3 on the enclosure data setting window a5 is pressed.

The sheet size can be set for each enclosure on the sheet size input window a6. In the present embodiment, sheet sizes smaller than the size of the envelope that has been inputs are selectable. More specifically, the insertion device 2 is immediate downstream from the image forming apparatus 1, that is, connected directly thereto, without a sheet folding device disposed therebetween in the present embodiment. Alternatively, in an arrangement in which a folding device is connected to the downstream side of the image forming apparatus 1 and the upstream side of the insertion device 2, the enclosure data setting window a5 includes folding setting as well.

The user inputs sheet size in each of the input fields for the enclosure data A, B, and C and presses the END SETTING button a24 to determine the sheet size.

3) Completion of Settings

After necessary settings are made, the user can finish the setting by pressing the END SETTING button a24 on the insertion tab a1. Thus, setting regarding image formation on the enclosure is completed.

Figure 23:
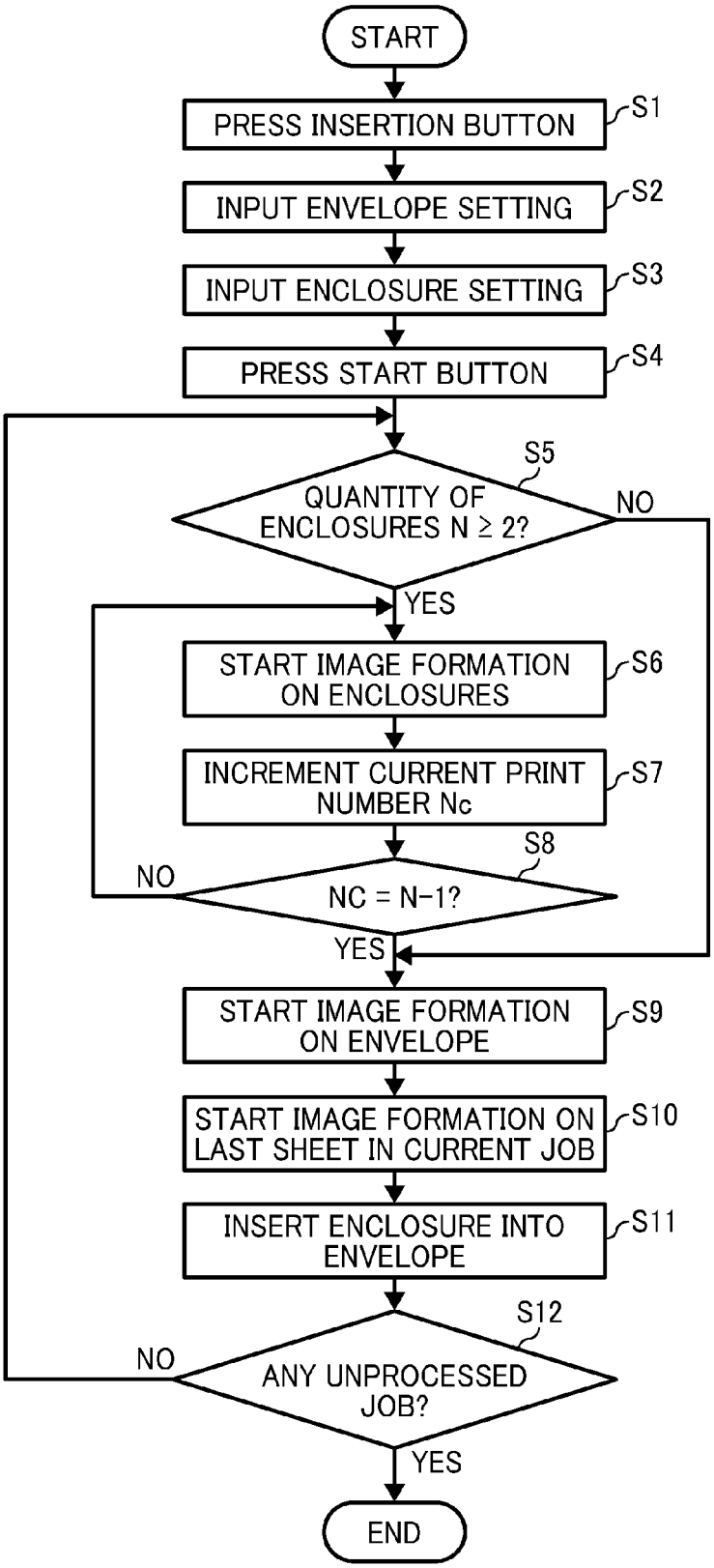
FIG. 23 is a flowchart illustrating a procedure of printing image data on envelopes and inserting enclosures in the envelopes (printing and insertion processing)

FIG. 23 is a flowchart of a sequence of printing image data on envelopes as well as enclosures and inserting enclosures into the envelopes (hereinafter "printing and insertion processing"). In the printing and insertion processing, at S1 the user presses the INSERTION tab a1 and performs envelope setting at S2 and enclosure setting at S3. It is to be noted that the order of envelope setting and enclosure setting is not limited to the above described order.

In envelope setting, the user selects the size or type of the envelope, inputs data to be printed, and correlates the envelope with the enclosure by inputting the enclosure data. In enclosure setting, the user inputs data necessary to form images on enclosures. For example, the user inputs the size of the sheet on which an image is formed on the screen display shown in FIG. 22. After the envelope setting and the enclosure setting are completed at S2 and S3, respectively, at S4 the user presses the START key d on the control panel 1-A to initiate printing and insertion operation.

Then, the insertion jobs are processed sequentially. It is assumed that the quantity of enclosures (i.e., total number of sheets inserted into a single envelope) in the respective insertion jobs is "N". At S5, the control circuit checks the quantity of sheets inserted into the envelope as enclosures in each insertion job. If the quantity N of enclosures is two or greater (Yes at S5), at S6 image formation on the enclosures is started. The image forming apparatus 1 performs image formation on the sheet fed from the sheet cassette 1-B selected in the enclosure setting, after which the sheet as the enclosure is transported to the temporary storage tray 15 inside the insertion device 2.

For example, the control circuit further includes a print number counter to indicate "current print number Nc", that is, the ordinal number of sheet on which an image is formed currently in the current insertion job. At S7, the control circuit increments by one the current print number Nc of enclosures. The control circuit further includes a comparison unit to compare the current print number Nc with the quantity N. At S8, the current print number Nc is compared with the quantity N of enclosures. When Nc<N−1, that is, the current print number Nc is smaller than the quantity N minus 1 (No at S8), the steps S6 and S7 are repeated for the number of times corresponding to the quantity N in the current job.

When the current print number Nc equals to the quantity N minus 1 (Yes at S8), image formation on the envelope is started. That is, when the image forming apparatus 1 performs image formation on the sheet whose ordinal number in the current job is N−1, at S9 the printing and feeding unit 2-B provided above the insertion device 2 performs image formation on the envelope as set in envelope setting. The envelope is then transported to the pair of chuck rollers 20 and 36 (envelope chuck unit 38) in the insertion device 2 and retained at the insertion position. Subsequently, at S10 the image forming apparatus 1 performs image formation on the last sheet in the current insertion job.

The image formation system is configured so that the insertion device 2 can make it in time by starting printing on the envelope when the image forming apparatus 1 forms the image on the sheet whose ordinal number is N−1. After all sheets inserted into a single envelope are transported to the temporary storage tray 15, at S11 insertion of enclosures is started. At S12 the control circuit checks whether or not any insertion job remaining. When there is any unprocessed insertion job (No at S12), at S5 the image forming apparatus 1 starts image formation on the enclosure in the subsequent job. The above-described processes are repeated for the number of jobs input. After insertion is completed, the envelope is discharged to the envelope tray 26.

In other words, in the above-described procedure, the start timing of image formation on the envelope (S9) is set so that the envelope can reach the envelope chuck unit 38 before the last sheet of enclosures reaches the temporary storage tray 15. The time at which the image forming unit 25-6 of the printing and feeding unit 2-B is set not to reduce productivity in printing on enclosures by the image forming apparatus 1.

Additionally, even if malfunction of the system occurs during image formation on the enclosures in a given insertion job in the above-described procedure, waste of envelopes can be reduced because printing on the envelope is not started until the second from the last sheet is printed. Additionally, when multiple printing and insertion jobs are processed in succession, productivity in image formation (i.e., image formation speed) of the image forming apparatus 1 is not reduced.

Figure 24A:
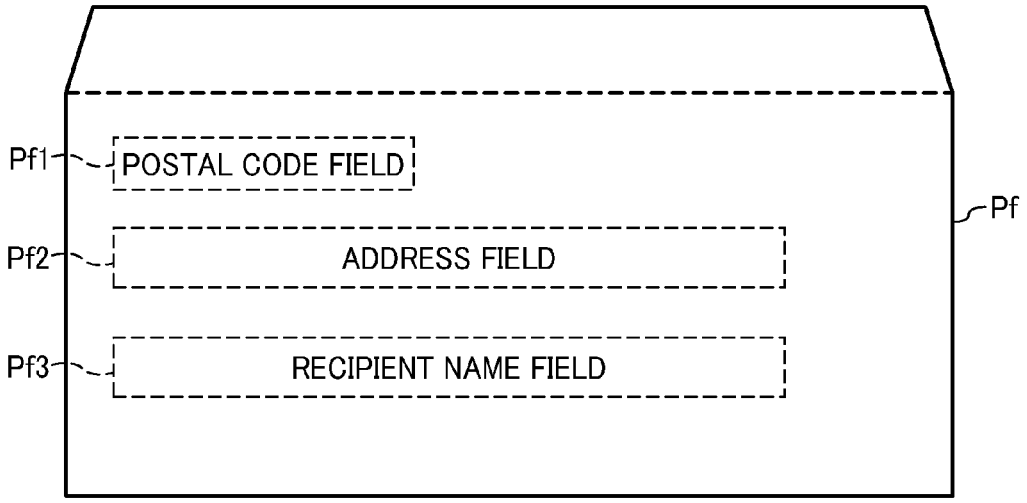
FIGS. 24A and 24B illustrate relations among directions of envelopes, the printing position, and directions of printing.
Figure 24B:
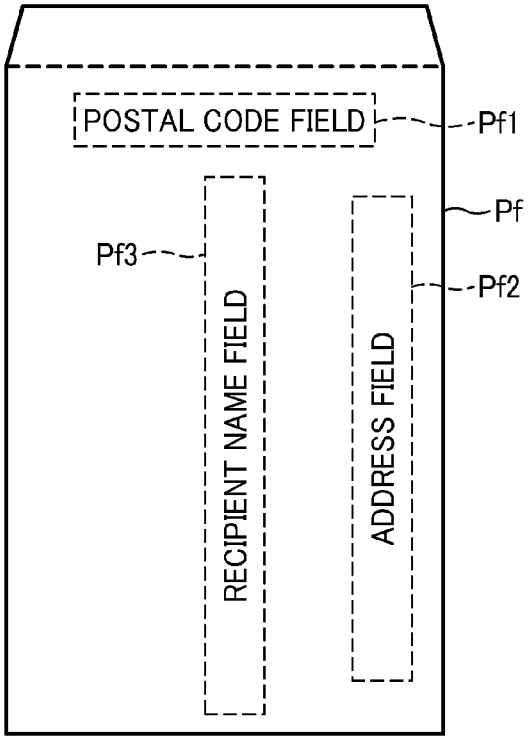

FIGS. 24A and 24B illustrate relations among directions of envelopes, the printing position, and directions of printing; FIG. 24A illustrates the printing position of horizontal writing on a landscape-oriented envelope, and FIG. 24B illustrates that of columnar writing on a portrait-oriented envelope.

The user can select envelope type using the ENVELOPE SELECT button a21, and input the printing position shown in FIG. 24A or 24B and what is printed on the address input window 905. Then, postal code, address, and recipient name are printed in a postal code field Pf1, an address field Pf2, and a recipient name field Pf3 of the envelope Pf, respectively, according to the data thus input.

For the image forming unit 25-6 including the ink-ejecting line head 25, it is relatively easy to change the printing position according to the size, direction, or type of the envelope Pf.

The output sequence of the input printing and insertion jobs can be changed as follows. When the JOB LIST button aj on the bottom of the display 900 is pressed, Table 1 described above is displayed. For example, output ordinal number of Nos. 3 and 5 jobs can be replaced as shown in Table 2 below.

TABLE 2

| No. | Output order | Postal code | Address | Recipient name | Sheet cassette | Feeding cassette | Enclosure data |
|---|---|---|---|---|---|---|---|
| 1 | 1 | xxx-xxxx | Tokyo | A | A | 1 | A, B, C |
| 2 | 2 | yyy-yyyy | Kanagawa | B | A | 1 | A, , B, C, , D |
| 5 | 5 | yyy-yyyy | Kanagawa | E | B | 2 | B, C |
| 4 | 4 | xxx-xxxx | Tokyo | D | B | 2 | B, C |
| 3 | 3 | zzz-zzzz | Ibaraki | C | A | 1 | A, B, C |
| 6 | 6 | zzz-zzzz | Ibaraki | F | B | 2 | C |

To change the output order, the user touches the job and drags it to a desired output number on the control panel 1-A. With this operation, the output ordinal number of that job as well as the setting of that job are changed and stored in the storage device.

The output order can be changed easily because the setting data of the envelope Pf is correlated with the enclosure data. Additionally, even if another job is being processed, the output order of unprocessed jobs can be changed unless printing of the enclosure or enclosures in that job is already started. Moreover, the respective items already input can be changed on the job list window.

As described above, the present embodiment can attain the following effects: 1) Unnecessary image formation on envelopes can be reduced by controlling the timing at which image formation on the envelope is started, which is particularly effective on the occurrence of malfunction or defective image formation during processing of the job; and 2) The output order of jobs can be changed easily.

As described above, in the present embodiment, the image forming system capable of insertion includes separate image forming units to form images on envelopes and enclosures, respectively, and enclosures can be inserted into envelopes reliably without reducing production efficiency.

Thus, the image forming system according to the present embodiment includes the image forming apparatus 1 (first image forming unit) to form images on sheets inserted into an envelope as enclosures, the printing and feeding unit 2-B (second image forming unit) to form images on the envelope, the insertion device 2 to insert the sheets into the envelope.

In the present embodiment, the sheets on which the image forming apparatus 1 has formed images are temporarily stored on the temporary storage tray 15 until the last of multiple sheets (enclosures) inserted into a single envelope reaches there, and the envelope chuck unit 38 serves as the envelope retainer to retain the envelope at the insertion position where the enclosure is inserted into the envelope. The control panel 1-A serves as an input device, and the CPU 2U serves as a controller as well as a printing position changer.

In printing and insertion processing, the second image forming unit forms an image on the envelope before the last sheet of multiple sheets inserted into a single envelope, on which the first image forming unit has formed an image, reaches the standby position (temporary storage tray 15) with a period of time for the envelope to reach the insertion position secured. For example, the second image forming unit may start image formation on the envelope earlier by a sum of an image formation time required for the image formation on the envelope and a conveyance time required for the envelope to reach the insertion position than the arrival of the last sheet to the temporary storage tray.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming system comprising:

an enclosure supply device including an enclosure container for containing sheets of recording media, the enclosure supply device to transport the sheets from the enclosure container;

a first image forming unit to form an image on the sheet;

an envelope supply device including an envelope container for containing envelopes, the envelope supply device to transport the envelopes from the envelope container;

a second image forming unit to form an image on the envelope;

an input device to input an insertion job and including an image setter to specify the image formed on the enclosure and the image formed on the envelope for each insertion job;

an insertion device to insert into the envelope at least one sheet on which the first image forming unit has formed the image, the insertion device including, a temporary storage tray to temporarily store the sheet on which the first image forming unit has formed the image until all of multiple sheets inserted into a single envelope reach the temporary storage tray, and an envelope retainer to hold the envelope at an insertion position where the sheets are inserted into the envelope;

a current ordinal number counter to count an ordinal number of the sheet on which the first image forming unit forms the image in a current insertion job; and a controller to communicably connected to the first image forming unit, the second image forming unit, the input device, and the insertion device, wherein the controller causes the second image forming unit to complete image formation on the envelope and conveyance of the envelope to the insertion position before a last sheet of the multiple sheets inserted into the envelope reaches the temporary storage tray, and wherein, when a quantity of sheets inserted into the envelope in the current insertion job is N, the second image forming unit starts image formation on the envelope when the first image forming unit forms an image on a sheet whose ordinal number is N−1 in the current insertion job.

2. The image forming system according to claim 1, further comprising an output order changer to change an output order of the images specified by the image setter.

3. The image forming system according to claim 1, further comprising a printing position changer to change a printing position on the envelope according to a envelope type, and the input device further includes an envelope type input unit to specify the envelope type for each insertion job.

4. The image forming system according to claim 1, wherein the image formed on the envelope comprises recipient data.

5. The image forming system according to claim 1, wherein the second image forming unit comprises a line ink-ejecting head.

6. The image forming system according to claim 1, wherein the first image forming unit is provided in an image forming apparatus, and the second image forming unit is provided to the insertion device positioned downstream from the image forming apparatus.

* * * * *